United States Patent [19]

Finn

[11] 4,193,340

[45] Mar. 18, 1980

[54] RECEPTACLE FOR BULK COLLECTION OF WASTE PAPER AND THE LIKE

[76] Inventor: Melvin Finn, 2509 Central Ave., Alexandria, Va. 22302

[21] Appl. No.: 922,174

[22] Filed: Jul. 5, 1978

[51] Int. Cl.[2] ..... B65B 13/18

[52] U.S. Cl. ..... 100/34; 211/50

[58] Field of Search ..... 100/1, 34; 211/50

[56] References Cited

U.S. PATENT DOCUMENTS

| | | | |
|---|---|---|---|
| 1,096,356 | 5/1914 | Downey | 100/34 |
| 2,747,498 | 5/1956 | Bellar | 100/34 |
| 2,839,990 | 6/1958 | Bailar | 100/34 |
| 3,897,724 | 8/1975 | McDonald | 100/34 |

*Primary Examiner*—Billy J. Wilhite

*Attorney, Agent, or Firm*—LeBlanc, Nolan, Shur & Nies

[57] ABSTRACT

Apparatus for bulk collection of waste paper, such as newspapers and the like, comprising: a generally rectangular base portion having a generally planer paper supporting surface containing means for defining a paper receiving area of lesser size than the total area of the planar paper supporting surface; recesses are located in the peripheral portion of the paper supporting surface outside the paper receiving area; upright guide members are located in corresponding recesses, for retaining stacked papers within the paper receiving area; and through holes are formed in the uprights above the maximum desired paper storage height for receiving an end of a paper tying string to be threaded therethrough prior to depositing papers into the collection apparatus.

7 Claims, 4 Drawing Figures

FIG. 1
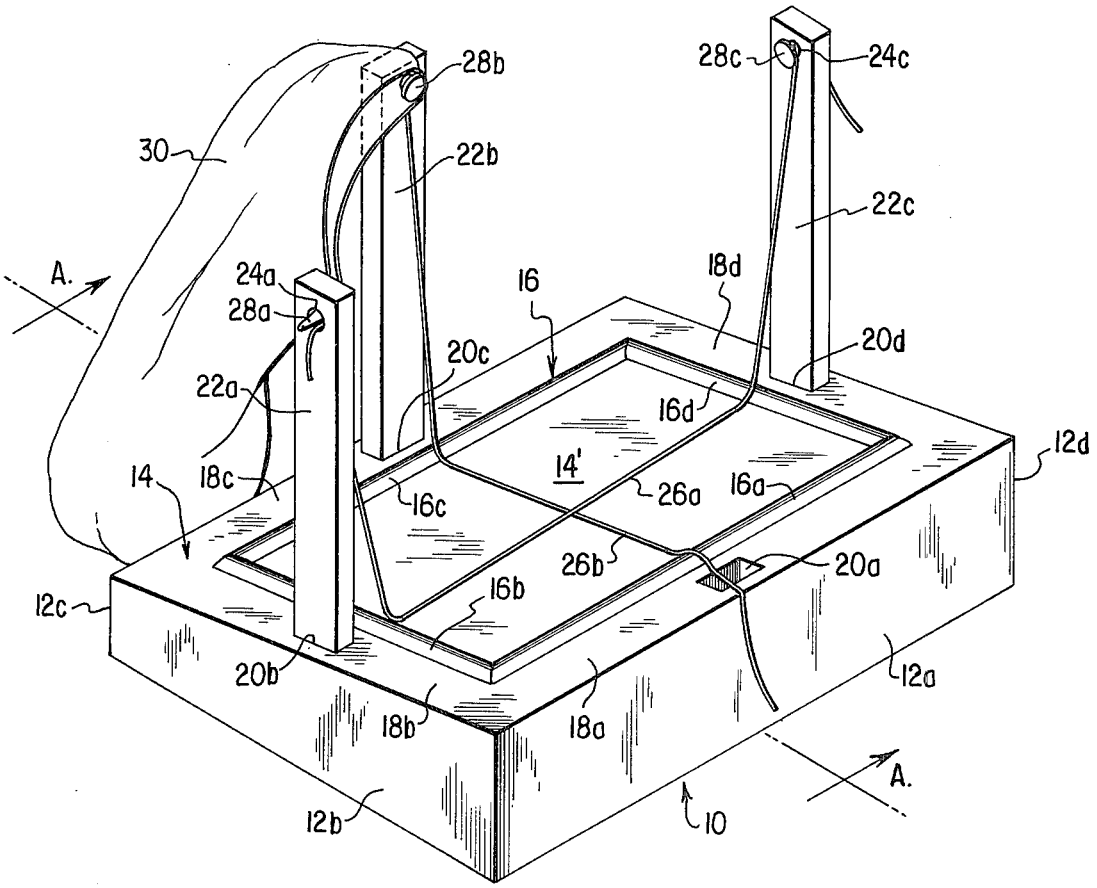
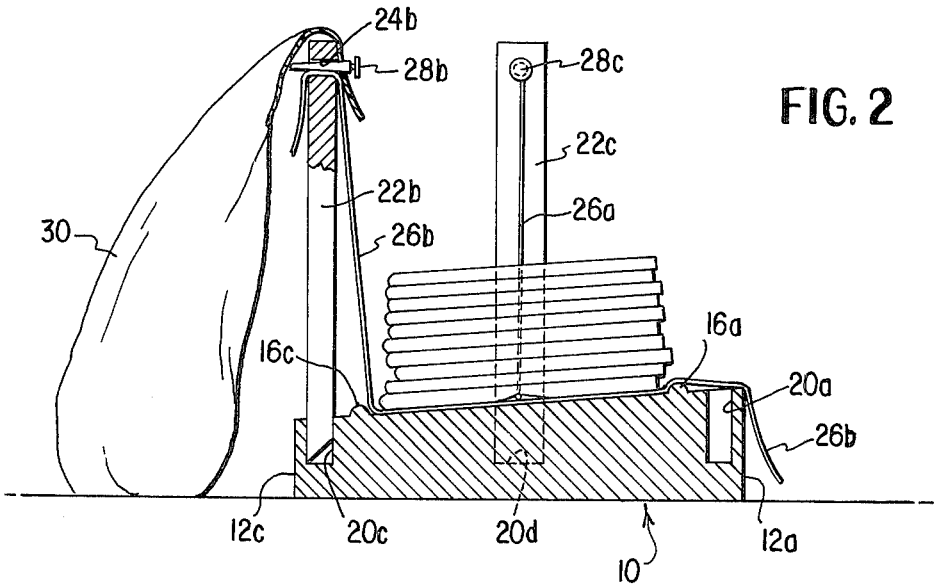
FIG. 2

RECEPTACLE FOR BULK COLLECTION OF WASTE PAPER AND THE LIKE

BACKGROUND OF THE INVENTION

This invention relates to a depository for scrap paper, mostly newspaper and the like. More specifically, it is a receptacle which facilitates the collection of paper at the users' level either as an individual or as a member of a group. This includes a member of a working group, a religious and/or non-profit group, a member or tenant in a condominium or apartment building or a veterans' group on a widely dispersed basis.

The collection and recycling of paper is a matter of grave concern to the nation as a whole since it represents an important saving of energy in an age of energy crisis and conservation of one of our most important resources. Two of the most important reasons why paper is difficult to collect and recycle are inherent in the problem of collection—that is, (a) encouraging the individual to collect or save it at the source; (b) once the individual has taken the time and effort to collect and/or store the paper, the cost of assembly in large amounts must be efficient and economically sound.

This invention deals with both of these problems. By placing these depositories in strategic places, it reminds each individual many times each day that his waste newspapers, etc., should be deposited in the receptacle. The depository, through its method of distribution installs automatically, a cheap but very reliable and effective source of collection. For example, the installation of one of these depositories in each of the waste or trash rooms in an apartment complex would remind each individual each time he deposits his trash that he should also be stacking his newspapers in the receptacle at the same time. It also presents a convenient collection point where maintenance personnel, (church or other similar organization) can efficiently and quickly assemble 50 pound units of waste paper for large scale movement for recycling.

By attaching a household plastic bag to the uprights by using plugs in the hole at the top of the upright, additional storage space may be had for aluminum cans or other salvageable items. By utilizing the same holes as a guide for string to lay across the storage area, one can accomplish the tying of the stored paper in appropriately sized piles for easy handling or further storage to accumulate sufficient paper to make it economically sound to proceed in the recycling process.

It is an object of the invention to provide an efficient and economical means for bulk collection of waste paper, such as newspapers and the like.

It is a further object to provide an efficient and economical means for quickly assembling bulk units of waste paper which can then be easily handled for large-scale movement, e.g., for recycling.

It is still a further object of the invention to provide means associated with the waste paper collection means for bulk collection of metal cans and other salvagable and recyclable bulky materials.

SUMMARY OF THE INVENTION

The invention described and claimed here comprises an apparatus for bulk collection of waste paper, such as newspapers and the like, having generally rectangular base portion with a generally planar paper supporting surface. The paper supporting surface contains means for generally defining a paper receiving area of lesser size than the total area of the planar paper supporting surface. Such means may comprise ridges forming a generally rectangular frame around the paper receiving area; alternatively, or additionally, the paper receiving area may be recessed relative to the peripheral portion of the planar surface.

Recesses are located in the peripheral portion of the paper supporting surface outside the paper receiving area, which locate upright guide members for retaining stacked papers within the paper receiving area. Through holes are formed in an upper end portion of each of the upright above the maximum desired paper storage height for receiving an end portion of a paper tying string to be threaded therethrough prior to depositing papers into the collection apparatus.

BRIEF DESCRIPTION OF THE DRAWING

FIG. 1 is a perspective view of the bulk paper collector showing the paper storage area and a hanging household plastic bag for storage of other bulky recyclable materials.

FIG. 2 is a sectional view of the receptacle taken along lines A—A in FIG. 1.

DESCRIPTION OF THE PREFERRED EMBODIMENT

Figure 3:
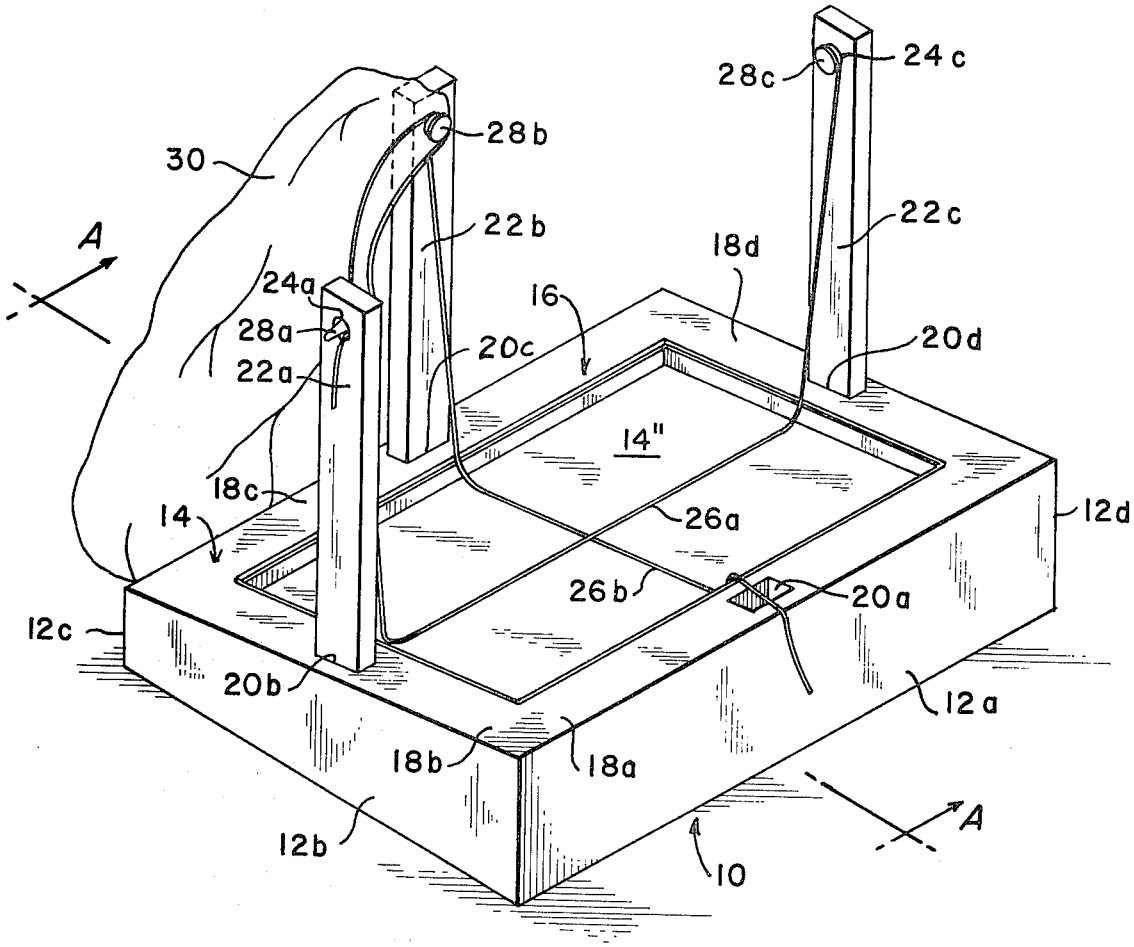
FIG. 3 is a perspective view of a modified form of the bulk paper collector.

The preferred embodiment of the bulk paper collector of this invention comprises a base, generally designated 10, which may be made of wood, metal or advantageously injection molded plastic. The base 10 comprises upright side members 12 and a generally flat top surface 14. A generally rectangular frame, designated 16 and defined by ridges 16*a*, 16*b*, 16*c*, 16*d*, is formed on top surface 14. Ridges 16 generally define the area within which at least the first few newspapers or other flat waste paper is to be placed on the base 10.

Figure 4:
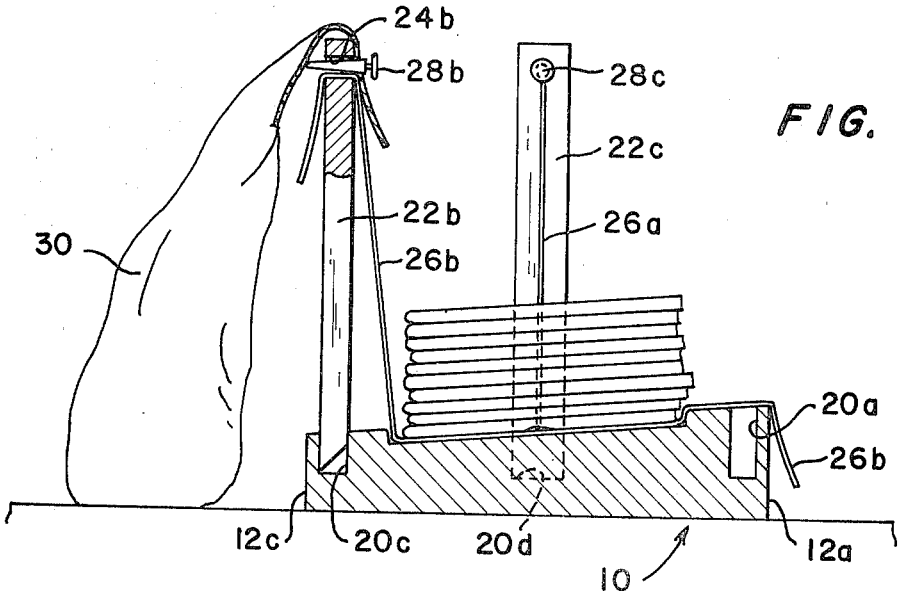
FIG. 4 is a sectional view of the receptable taken along the lines A—A in FIG. 3.

Alternatively, or in addition to ridges 16, the area 14' (FIG. 1) of surface 14 defined within the frame 16 may be recessed (at 14'' of FIG. 3) relative to a peripheral portion 18 of top surface 14 outside frame 16, as shown in FIGS. 3 and 4. It is intended that either construction will facilitate the location of at least the first few newspapers as they are tossed into the collector.

A plurality of recesses 20 extend downwardly from the peripheral portion 18 of the top surface 10. Advantageously, at least four such recesses are provided as shown in FIG. 1; additional recesses (not shown) may be provided, especially on the longer sides 18*a*, 18*c* of the top surface 14.

Upright members 22 seat in corresponding recesses 20 to further define the area in which newspapers are to be located in the collector. Advantageously, one side (e.g., the front side) of the collector is left open to make it easier for people to throw newspapers onto the pile being collected while the three uprights in use guide such thrown newspapers onto the stack being formed. The bottom portion of recesses 20 and the lower end portions of uprights 22 may be beveled in a complementary manner to produce a wedging action when an upright 22 is fitted into a recess 20, to thereby provide additional strength for the mounting of the uprights without the necessity of using additional hardware such as screws or the like.

Advantageously, the bottom 11 of base 10 is beveled from front to rear so that when the collector rests on a flat floor, it will have a slight rearward tilt. This further assists in retaining the papers within the confines of the collector as they are thrown onto the pile.

At their upper ends, the uprights 22 are provided with through holes 24. When the collector is empty, newspaper tying string 26 is threaded through the holes 24 so that it naturally falls downwardly along the face of the upright 22 to rest on the surface 14 of the base 10. Between opposed uprights (e.g., uprights 22*a* and 22*c*), one tying string 26*a* is threaded through the hole in both uprights and allowed to rest on the surface 14. A second string 26*b* is threaded through the hole in upright 22*b* and is located on the surface 14 crosswise to string 26*a*. Tying string 26*b* is made sufficiently long to extend over side 12*a*. Sufficient string is allowed to hang on the outside of each of the uprights so that when the collector is filled, the string can be pulled through the holes 24 and the ends tied at the top of the stack.

Each hole 24 is provided with a plug 28 which is wedged into the cooperating hole 24 to secure the string therein and prevent it from being pulled out of the hole as newspaper is added to the pile.

The spacing of the uprights is such and the dimensions of the through hole 24 are such that a household plastic bag 30 can be secured to the uprights with its top open to allow bulky items such as metal cans, paper boxes, and the like to be easily thrown into the bag. Preferably, such bag is placed over the tops of two adjacent uprights (e.g., 22*a* and 22*b*) and is secured thereto by the plugs 28 in through holes 24.

Referring to FIG. 2, the stored papers are shown stacked ready for tying. When the paper has reached the appropriate height for removing from the receptacle, it is tied and either sent to a central storage place such as would exist in an apartment building or would be stored until sufficient paper was accumulated to make it economically feasible to transport to a central location for further processing.

The plastic bag is placed over the top of the two uprights, and the bag is folded over the top of the uprights so that the bag covers the holes at the top of the uprights. The plugs are then pushed into the hole, holding the plastic bag in the holes. When the bag is filled, the plugs are removed, and the bag is closed and sent to a central location for appropriate distribution.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced herein.

What is claimed is:

1. Apparatus for bulk collection of waste paper, such as newspapers and the like, comprising:

a generally rectangular base portion having a generally planar paper supporting surface, and upstanding ridges on said paper supporting surface forming a generally rectangular frame for generally defining a paper receiving area of lesser size than the total area of the planar paper supporting surface;

a plurality of recesses located in the peripheral portion of the paper supporting surface outside the paper receiving area, wherein each side lof the peripheral portion of the paper supporting surface contains at least one such recess;

a plurality of upright guide members, each located in a corresponding one of said recesses, for retaining stacked papers within said paper receiving area; and at least one through hole formed in an upper end portion of each of said uprights above the maximum desired paper storage height for receiving an end portion of a paper tying string to be threaded therethrough prior to depositing papers into the collection apparatus.

2. Apparatus according to claim 1, wherein the bottom of the base is beveled from front to rear to impart a rearward tilt to the paper supporting surface when the collection apparatus is located on a generally flat floor.

3. Apparatus according to claim 2, wherein said upright guide members provide means for supporting a trash bag into which bulky recyclable items may be placed for bulk collection.

4. Apparatus for bulk collection of waste paper, such as newspapers and the like, comprising:

a generally rectangular base portion having a generally planer paper supporting surface, wherein the bottom of the base portion is beveled from front to rear to impart a rearward tilt to the paper supporting surface when the collection apparatus is located on a generally flat floor, said base portion containing means for generally defining a paper receiving area of lesser size than the total area of the planer paper supporting surface;

a plurality of upright guide members, extending upwardly at least from the opposite side portions and rear portion of said base portion for retaining stacked papers within said paper receiving area; and at least one opening formed in an upper end portion of at least opposite ones of said upright guide members above the maximum desired paper storage height for receiving an end portion of a paper tying string to be threaded therethrough prior to depositing papers into the collection apparatus.

5. Apparatus according to claim 4, wherein said means for generally defining a paper receiving area comprises upstanding ridges on said planar paper supporting surface, said ridges forming a generally rectangular frame generally defining the outer boundary of said paper receiving area.

6. Apparatus according to claim 4, wherein said means for generally defining a paper receiving area comprises a general centrally located, generally rectangular portion of th planar paper supporting surface which is recessed relative to the peripheral portion thereof.

7. Apparatus according to claim 1, 5 or 6, further comprising plug means removably securable in said throughholes for securing tying string threaded therethrough.

* * * * *